United States Patent [19]

Ochel et al.

[11] Patent Number: 4,856,985

[45] Date of Patent: Aug. 15, 1989

[54] DEVICE FOR FEEDING GASES INTO COMBUSTION CHAMBERS AND PROCESS FOR DIMINISHING POLLUTANTS DURING COMBUSTION OPERATIONS

[75] Inventors: Klaus-Peter Ochel, Pulheim; Joachim Krupp; Josef Heger, both of Dormagen; Martin Schweitzer, Odenthal, all of Fed. Rep. of Germany

[73] Assignees: Ec Erdolchemie GmbH, Koeln-Worringen; Bayer Aktiengesellschaft, Leverkusen, both of Fed. Rep. of Germany

[21] Appl. No.: 240,889

[22] Filed: Sep. 6, 1988

[30] Foreign Application Priority Data

Sep. 17, 1987 [DE] Fed. Rep. of Germany ..... 3731205

[51] Int. Cl.[4] ..... F23D 13/20

[52] U.S. Cl. ..... 431/202; 431/171; 431/160

[58] Field of Search ..... 431/5, 8, 10, 160, 162, 431/175, 190, 202, 217, 242, 247, 354, 171; 239/422, 427.5, 432, 434.5, 461

[56] References Cited

U.S. PATENT DOCUMENTS

| | | | |
|---|---|---|---|
| 3,468,634 | 9/1969 | Pauletta | 431/202 X |
| 3,501,255 | 3/1970 | Greene | 431/202 |
| 3,649,206 | 3/1972 | Ivernel | 431/171 X |
| 3,873,671 | 3/1975 | Reed et al. | 431/5 X |
| 3,994,671 | 11/1976 | Straitz, III | 431/5 X |
| 3,995,986 | 12/1976 | Straitz, III | 431/202 X |
| 4,145,979 | 3/1979 | Lilley et al. . | |
| 4,538,982 | 9/1985 | McGill et al. . | |
| 4,548,576 | 10/1985 | Chesters | 431/202 |

FOREIGN PATENT DOCUMENTS 2456285 12/1980 France .

OTHER PUBLICATIONS

European Search Report, German Refs., (Wissenschaftliche Forschungsarbeit; Verbrennung von ammoniak-und stickoxidhaltingen Bruden in einem Drallbrennkammersystem; VDI Berichte, pp. 440–445).

*Primary Examiner*—Randall L. Green

*Attorney, Agent, or Firm*—Sprung Horn Kramer & Woods

[57] ABSTRACT

The invention relates to a device for feeding gases, aerosols and/or mixtures of gases and solids into the combustion of a steam boiler or other combustion chambers using heat, and a process for diminishing pollutants, which are formed when burning gases, aerosols and/or mixtures of gases and solids in steam boilers or other combustion chambers using heat.

6 Claims, 1 Drawing Sheet

DEVICE FOR FEEDING GASES INTO COMBUSTION CHAMBERS AND PROCESS FOR DIMINISHING POLLUTANTS DURING COMBUSTION OPERATIONS

BACKGROUND OF THE INVENTION

The present invention relates to a device for feeding gases, aerosols and/or mixtures of gases and solids into the combustion of a steam boiler or other combustion chambers using heat, and a process for diminishing pollutants, which are formed when burning gases, aerosols and/or mixtures of gases and solids in steam boilers or other combustion chambers using heat.

Usually a waste gas containing a nitrogen compound is disposed of in a two-stage combustion chamber, the first chamber operating with a certain amount of oxygen removed and the second one with a corresponding amount of oxygen added. In addition a heat exchanger is positioned between the two combustion chambers, to minimise the thermal production of $NO_x$. Plants having two-stage combustion are known from R. Römer, W. Leukel, A. Stoeckel and G. Hemmer's "Effect of producing nitrogen oxide from nitrogen bonded with fuel using combustion methods, Chem.-Ing.-Techn. MS 875/81" or O. Carlowitz, H. Wiebe and U. Gravemeier's "Combustion of vapours containing ammonia and nitrogen oxide in a spin combustion chamber system, VDI-Reports No. 423/81".

These combustion plants are primarily used for reducing harmful substances, whereby there is a considerably smaller amount of flue gas than with combustion processes in power stations. Adding a combustion chamber, which is operated with a deficiency of air, to a steam boiler with forced circulation is ruled out due to the altered heat release and consequent change in the local heat exchange.

The amount of $NO_x$ emitted can be decreased by using suitable burners. There are zones within the burner flame which are produced by feeding specific amounts of air and fuel, and which have a deficiency of air and corresponding amount of CO, which in turn reduces the $NO_x$. These burners are more effective if oxygen-enriched combustion air, which is mainly available as a mixture of fresh air and recycled flue gas, is added at a suitable place, reducing the flame temperature as well as the oxygen supply.

Furthermore, it is known from VDI-Reports No. 574, pages 443 ff, that to minimise the $NO_x$ content in flue gas, fuel containing nitrogen is used in combustion plants with burners, to modify the fuel concentration and air mass to the individual burners.

These methods can only be used with low volumetric rates of the waste gas flow which contains nitrogen compounds. This waste gas should be fed in the direct region of the flame, otherwise it will not mix at all or at most very insubstantially with the reducing agent.

SUMMARY OF THE INVENTION

It is therefore the aim of the invention to design a device which does not display the aforementioned disadvantages.

Surprisingly it has now been found that the waste gas values can be considerably improved by altering the feed of waste gas with standard burners. The feed can be altered using a protective attachment at the end of the gas collecting tube.

BRIEF DESCRIPTION OF THE DRAWING

The numbering used below refers to the FIGURE which shows a sectional view a preferred embodiment of the device according to the invention.

DETAILED DESCRIPTION OF THE INVENTION

Figure 1:
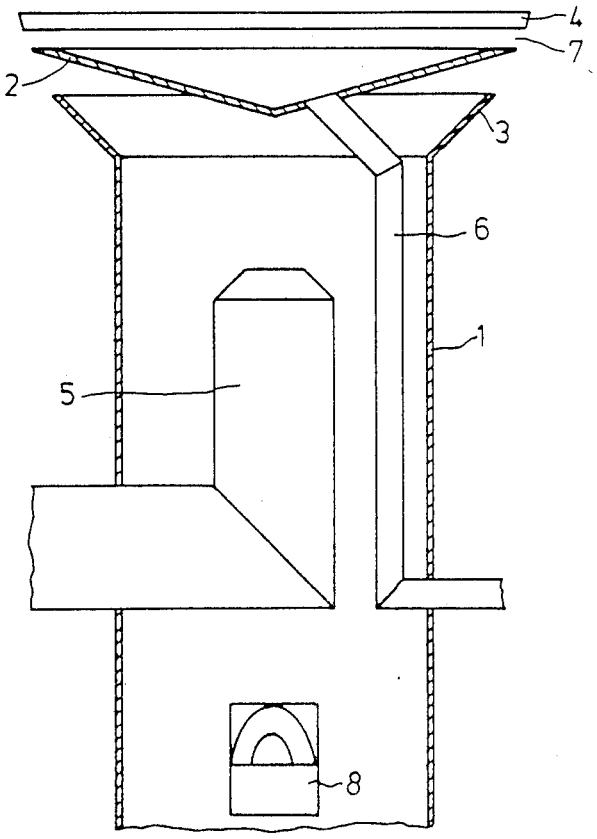

The object of this invention is a device for feeding gases, aerosols and/or mixtures of gases and solids into the combustion chamber of a steam boiler or other combustion chambers using heat, characterised in that a protective attachment (2) is positioned in the center of the outlet of a gas collecting tube (1) in such a way that the gas, aerosol and/or gas-solid compound can be cyclically fed into the combustion chamber having an aperture at an angle of $>90°$, preferably 120° to 150°.

According to the invention it is advantageous for the gas collecting tube (1) to have an annular extension (3), through which the gas flow can be optimised. It is also advantageous to position a cooling device (4) on and/or above the protective attachment (2). This cooling device protects the device according to the invention against heat which is emitted. It can be composed of preferably s-shaped cooling coils which have liquid flowing through them. Furthermore, a particularly preferred embodiment of the device according to the invention lies in one or several feeding elements (5) being arranged in the gas collecting tube (1). Through this feeding element additional gas flows can be introduced, e.g. air or oxygen. Also one or several elements (6) which feed in combustible gas. can be positioned in the gas collecting tube (1) in such a way that the combustible gas can reach the outlet region (7) or the gas collecting tube (1).

To stabilize the flow and improve the mixing efficiency within, the gas is let in through (5) and (6) either excentrically or in another way which improves the mixing. Furthermore the device itself is able to heat up to 800° C. to 1000° C. by direct or indirect heating, e.g. by electrically heating the outer surface of the device. It is thereby possible to pyrolise and consequently purify products which tend to bake on, when the gas flow in the device is shut off.

A preferred embodiment of the device according to the invention lies in a burner (8) being arranged in the gas collecting tube (1) for purifying purposes.

Another object of this invention is a process for diminishing pollutants obtained during the combustion of gases, aerosols and/or gas-solid mixtures in steam boilers or other combustion chambers using heat, characterised in that the gases, aerosols and/or gas-solid mixtures are distributed into the combustion chamber by means of above described device.

Following the process according to the invention it is possible for example to reduce considerably the conversion rate of a waste gas containing nitrogen when disposing of waste in steam boilers or other combustion chambers using heat. For this purpose the waste gas flows upwards against the combustion level of the first burner through the device according to the invention into the combustion chamber of a steam boiler, in such a way that the conditions for mixing and retention time are at their best. With the device according to the invention it is also possible to adapt optimally the waste gas itself to combustion conditions by admixing the gaseous fuel and gaseous oxygen carriers.

In the device to the invention the gas outlet speeds are 10 m/s to 80 m/s, preferably 20 m/s to 40 m/s. The process according to the invention is particularly suitable for combustion operations, in which the gases and/or gas-solid mixtures contain nitrogen and/or compounds of nitrogen.

Therefore accoring to the invention large quantities of low-calorific waste gas containing nitrogen compounds can be injected into a large combustion chamber, preferably into the cooled combustion chamber of a boiler for producing steam. The quantity of flue gas derived from the waste gas can be up to approximately 50% of the total flue gas quantity with a corresponding calorific value. The waste gas itself can contain up to several 10,000 ppm compounds of nitrogen, e.g. HCN, which can be split up by heat and to a large extent react with oxygen to produce NO or $NO_2$. In initial tests the decrease in $NO_x$ was between 61% and 48%, with proportions of 13% and 32% of the waste gas respectively at the aforementioned volumetric rate of flow of flue gas.

The following description is introduced to be an example for illustrating purposes only.

EXAMPLE

Generally the waste gas containing nitrogen compounds was fed through 34 tubes of the size described in DN 100 arranged in a central mushroom-shaped feeder, approximately 2 m below the combustion level of the first burner, which consists of 4 corner burners, into the combustion chamber of a steam boiler having a cross-section of 4 m by 4 m. The tubes in the mushroom-shaped feeder are positioned at an angle of 20° with the axis of the combustion chamber. The waste gas had a low calorific value of 0.8 $MI/m^3$ to 1.2 $MI/m^3$ and can typically contain up to 4% hydrogen cyanide and oxygen, and 89% nitrogen for each and at any one time a maximum of 2.2% carbon dioxide, water vapour and carbon monoxide, and traces of various organic compouns. According to the invention the waste gas was fed through the device shown in the FIGURE in such a way that the mushroom-type distributor was fitted with an attachment so that the waste gas flowed into the combustion chamber through an aperture at an angle of approximately 180°. The new type of distributor, which was fitted with an uncooled dual heat protector, was arranged at the outlet corresponding with the FIGURE in such a way that the waste gas could flow out of an annular aperture of 100 mm having an average diameter of 1060 mm. With regard to the $NO_x$ values measured with standard mushroom-type distributors, the $NO_x$ content, which was obtained and calculated according to GFAVO, was diminished using the boiler subload and approximately 65,000 $m^3/h$ flue gas in the 8 gas burners arranged in two combustion levels, using the device according to the invention by introducing 10,000 $m^3/h$ waste gas at 61% and 30,000 $m^3/h$ at 48% under the same operating conditions. The remaining oxygen content was 1% at the end of the combustion chamber.

What is claimed is:

1. A device for feeding gases, aerosols and/or mixtures of gases and solids into a combustion chamber using heat, comprising: a gas collecting tube having a longitudinal axis, means forming an outlet opening and a protective attachment positioned in the center of the outlet opening of the gas collecting tube and including a cooling device positioned one of on and above the protective attachment, wherein the means forming the outlet opening and the protective attachment define an aperture through which gas, aerosol and gas-solid compound is fed into the combustion chamber at an angle of $>90°$ with respect to the longitudinal axis of the tube and $>0°$ with respect to the horizontal.

2. The device according to claim 1, wherein the angle is from 120° to 150°.

3. The device according to claim 1, wherein the means forming the opening comprises an outwardly flaring annular extension.

4. The device according to claim 1, further comprising at least one feeding element disposed in the gas collecting tube.

5. The device according to claim 1, further comprising at least one feeding element for feeding in combustible gas positioned in the gas collecting tube to feed the combustible gas into an outlet-region above the protective attachment.

6. The device according to claim 1, further comprising a burner disposed in the gas collecting tube for purifying.

* * * * *